US006670019B2

(12) United States Patent
Andersson

(10) Patent No.: US 6,670,019 B2
(45) **Date of Patent: *Dec. 30, 2003**

(54) ARRANGEMENT FOR JOINTING TOGETHER ADJACENT PIECES OF FLOOR COVERING MATERIAL

(75) Inventor: Kjell Andersson, Violvägon (SE)

(73) Assignee: AB Golvabia, Anderstorp (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/297,761

(22) PCT Filed: Oct. 24, 1997

(86) PCT No.: PCT/SE97/01780

§ 371 (c)(1),
(2), (4) Date: May 7, 1999

(87) PCT Pub. No.: WO98/21428

PCT Pub. Date: May 22, 1998

(65) Prior Publication Data

US 2003/0091780 A1 May 15, 2003

(30) Foreign Application Priority Data

Nov. 8, 1996 (SE) ..... 9604105

(51) Int. Cl.[7] ..... B32B 3/02; B32B 33/00; E04F 15/02

(52) U.S. Cl. ..... 428/90; 428/88; 428/48; 428/60; 52/390; 52/392

(58) Field of Search ..... 428/90, 88, 33, 428/57, 58, 60, 48, 81, 82, 83; 52/391, 392, 390

(56) References Cited

U.S. PATENT DOCUMENTS

| | | | | |
|---|---|---|---|---|
| 1,864,774 | A | 6/1932 | Storm | 52/403.1 |
| 2,900,676 | A | 8/1959 | Kahr | 52/592.1 |
| 3,777,435 | A | 12/1973 | Perina | 52/DIG. 13 |
| 4,271,566 | A | 6/1981 | Perina | 52/DIG. 13 |
| 4,879,854 | A | 11/1989 | Handler | 52/DIG. 13 |
| 5,362,560 | A | 11/1994 | Ehrhart et al. | 52/392 X |
| 5,618,602 | A | 4/1997 | Nelson | 52/592.1 X |
| 5,678,369 | A | 10/1997 | Ishikawa et al. | 52/592.1 X |

FOREIGN PATENT DOCUMENTS

| | | | |
|---|---|---|---|
| DE | 2427712 | A1 | 12/1975 |
| EP | 0161637 | A2 | 11/1985 |
| FR | SE 503973 | | 10/1957 |
| SE | FR 1144025 | | 10/1996 |
| WO | WO 9508033 | A1 | 3/1995 |
| WO | WO 93/18782 | * | 6/1996 |
| WO | WO96/23942 | | 8/1996 |

* cited by examiner

*Primary Examiner*—Cheryl A. Juska
(74) *Attorney, Agent, or Firm*—Bachman & LaPointe, P.C.

(57) ABSTRACT

In an arrangement for jointing together adjacent pieces of floor covering material, mutually facing edge portions of the pieces in a joint are profiled such that the one piece has a groove-shaped accommodation space in which a corresponding bead-shaped projection on the other piece may be accommodated. The one piece has a flocking which is disposed for holding together adjacent pieces. The profiling has, besides the accommodation space and the projection, mutually facing surfaces on both pieces, at least one of these surfaces being flocked. The flocking or flockings are located outside the defining surfaces of the accommodation space and the projection.

10 Claims, 2 Drawing Sheets

ARRANGEMENT FOR JOINTING TOGETHER ADJACENT PIECES OF FLOOR COVERING MATERIAL

TECHNICAL FIELD

Figure 1:
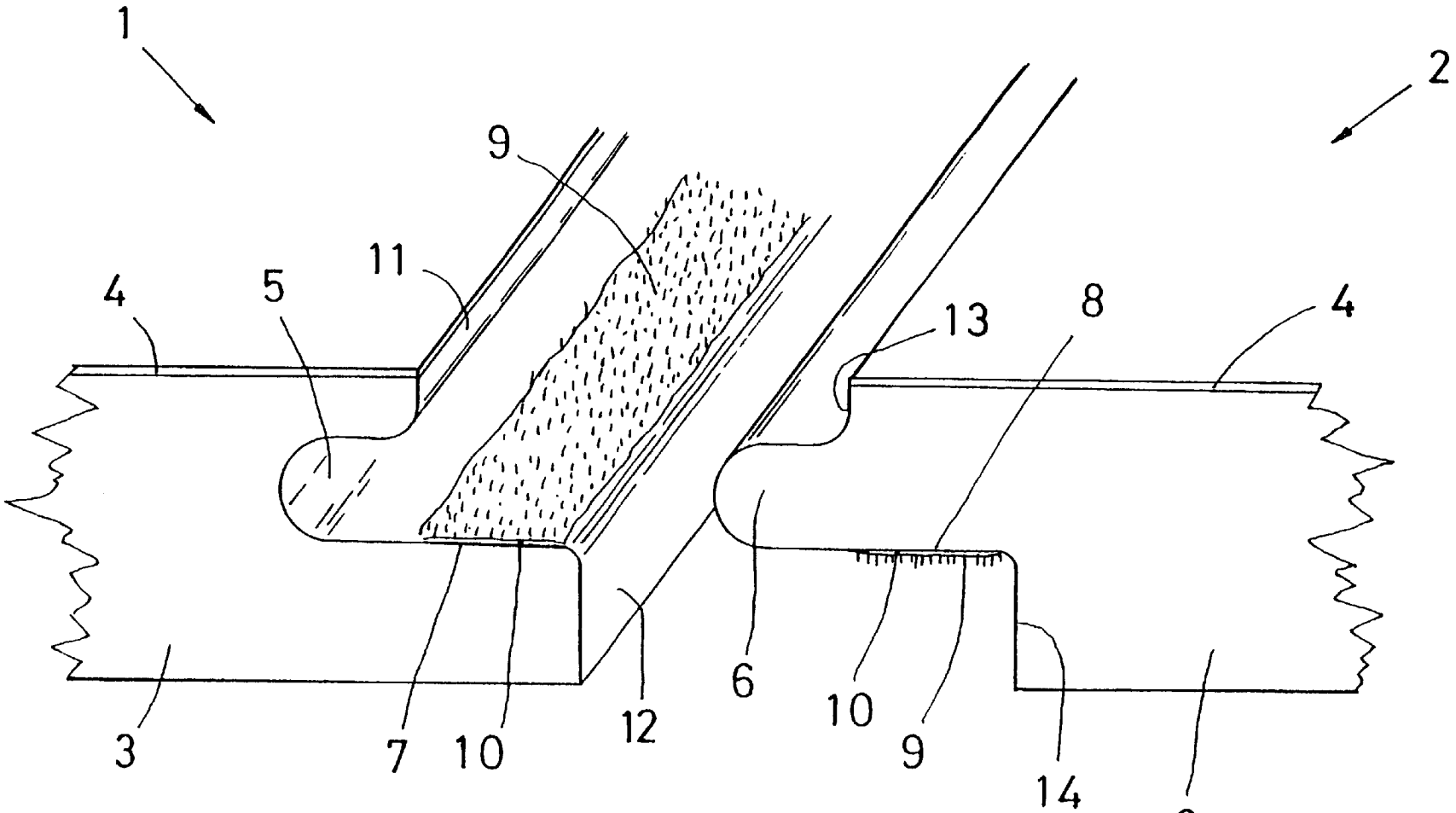

The present invention relates to a jointing of adjacent pieces of floor covering material, edge portions of the pieces facing towards one another in a joint being profiled such that the one piece has a groove-shaped accommodation space in which a corresponding bead-shaped projection on the other piece may be accommodated, and at least one of the pieces displaying a flocking which is provided for joining together adjacent pieces.

BACKGROUND ART

SE 503 917 C2 discloses a structure of the above-outlined type. In this structure, the one piece of floor covering material has its accommodation space designed as a groove, while the other piece of floor covering material has its projection designed as a tongue. According to this patent specification, at least one of adjacent surfaces on the tongues and grooves of the pieces is provided with flocked surface portions.

The structure according to the above-disclosed patent specification provides a very reliable jointing together of adjacent pieces of floor covering material, but also suffers from certain difficulties.

Since the described structure realises a considerable resistance against separation of adjacent pieces, assembly and jointing together of these pieces will be correspondingly difficult, since the pieces must be slid in place in a direction which is wholly opposite to the direction of withdrawal. The grip of the flocking is the same in both directions.

Further, manufacture of such jointing may offer certain problems in that use is made of electrostatic fields in the application of the flocking. It has proved difficult to realise a more or less uniform and sufficiently powerful electrostatic field at least interiorly in the grooves.

PROBLEM STRUCTURE

The present invention has for its object to obviate the drawbacks inherent in prior art structures, in particular in the structure as disclosed in the above-considered patent specification. Thus, the present invention has for its object to design the structure intimated by way of introduction such that it obviates the drawbacks inherent in the prior art methods and devices. In particular, the present invention has for its object to design the arrangement mentioned by way of introduction such that jointing together of adjacent pieces of floor covering material is substantially facilitated without the union bond of the pieces in the assembled state being weakened or otherwise jeopardised. Further, the present invention has for its object to design the arrangement such that its manufacture is considerably facilitated. Finally, the present invention generally has for its object to realise an arrangement which is economical and simple in manufacture, convenient in assembly and also displays good mechanical strength in the assembled state.

SOLUTION

The objects forming the basis of the present invention will be attained if the arrangement intimated by way of introduction is also characterized in that the profiling besides the accommodation space and the projection has mutually facing surfaces on both of the flooring pieces, at least one of these surfaces being flocked.

Further advantages will be attained according to the present invention if the arrangement is also given one or more of the characterizing features as set forth in the instant specification.

The present invention also relates to a floor covering material which has the same sought-for properties as the above-considered arrangement.

BRIEF DESCRIPTION OF THE ACCOMPANYING DRAWINGS

Figure 2:
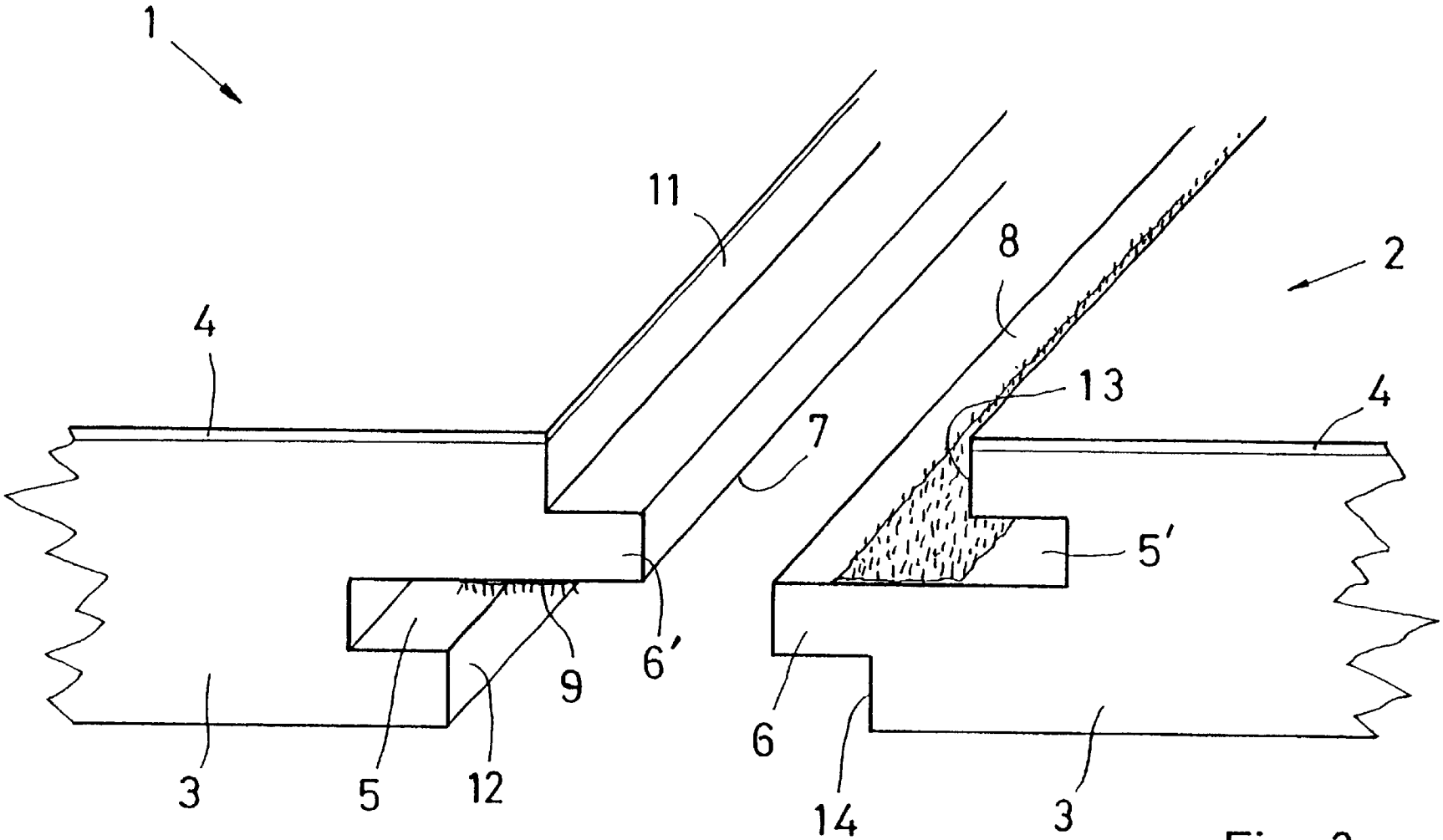

The present invention will now be described in greater detail hereinbelow, with reference to the accompanying Drawings. In the accompanying Drawings:

FIG. 1 shows in perspective corner portions of two pieces of floor covering material laid against one another; and FIG. 2 is a view corresponding to that of FIG. 1 of a second embodiment of the present invention.

DESCRIPTION OF PREFERRED EMBODIMENT

FIG. 1 shows in perspective two pieces 1 and 2 of a floor covering material designed according to the invention. The pieces 1 and 2 are preferably of identical design, for which reason the piece 1 (to the left in the Figure) has a left-hand edge (not shown) which is designed in the same manner as the left-hand edge of the piece 2 shown in the Figure.

Conversely, the opposite relationship naturally applies such that the piece 2 has a right-hand edge (not shown) which corresponds to the right-hand edge of the piece 1 according to the Figure. The end surfaces of the pieces 1 and 2 may be cut as shown in the Figure, but may also be profiled in the manner shown on the pieces 1 and 2.

Each piece 1 and 2 has a bearing, panel-shaped portion 3 which may consist of chipboard, MDF plate, coreboard, solid wood, etc. Further, each piece has a wear surface 4 which preferably consists of a high-pressure laminate or the like. On the underside, the pieces have a barrier layer which prevents the pieces from warping in the event of variations in moisture content and temperature.

Alternatively, the pieces 1 and 2 may, in their central region counting in the vertical direction, have a core of the same material type as the bearing portion 3. On the upper side of this core, there is then provided a wear layer of relatively thick wood veneer, while there is disposed on the underside a corresponding barrier layer.

Regardless of how the pieces 1 and 2 are composed, they are provided, along their edge portions facing towards one another in a joint, with profiles which, on the one piece, comprise a groove-shaped accommodation space in which a corresponding bead-shaped projection on the other piece may be accommodated. Suitably, the accommodation space and the projection are approximately complementary to one another.

The profilings on the two pieces 1 and 2 further include, in addition to the accommodation space 5 and the projection 6 in the jointed state of the pieces, mutually facing and substantially mutually abutting surfaces 7 and 8, respectively. These mutually facing surfaces 7 and 8 are preferably approximately parallel with the plane of extent of the pieces 1 and 2, such that the one surface 7 will be turned to face upwards and the other surface 8 will be turned to face downwards. Of the mutually facing surfaces, at least one is provided with a flocking 9 for interconnecting the adjacent surfaces 1 and 2.

If maximum reliability is to be achieved against separation of the pieces 1 and 2 from the jointed state, both of the surfaces 7 and 8 are suitably provided with flocking.

In the vertical direction (thickness) of the pieces 1 and 2, the two mutually facing surfaces 7 and 8 are located approximately in the central region. This affords the advantage that the portions of the profilings which carry the two surfaces 7 and 8 and the flocking or flockings 9 (and thereby are to hold together the pieces) display superior mechanical strength. However, the surfaces 7 and 8 may be located lower, for example down towards a third of the distance from the bottom.

On application of the flocking or flockings 9, the relevant surface 7 or 8 (or both) is provided with a strip-shaped application of an adhesive 10 in which short pieces of fibre are secured. By exposing the fibres to an electrostatic field, these will be charged and repel one another, for which reason they will, before the adhesive has dried or hardened, be aligned in directions which are substantially at right angles in relation to the plane of the surfaces 7 and 8. Given that the surface portions coated with the flocking 9 are disposed substantially outside these surfaces which define the accommodation space 5 and the projection 6, no problems arise as regards the electrostatic field. An interior coating in a groove of the type represented by the accommodation space 5 could, on the other hand, present difficulties.

The profiling of the two pieces 1 and 2, which are substantially complementary to one another, further includes upper and lower transverse surfaces 11 and 12, and 13 and 14, respectively. Of these surfaces, the upper transverse surfaces 11 and 13 may be considered as complementary to one another, which also applies to the lower surfaces 12 and 14. Further, the accommodation space 5 and the projection 6 are suitably complementary to one another.

The surfaces 11–14 are transversely directed in relation to the plane of extent of the two pieces 1 and 2 and are suitably approximately at right angles to these planes. Further, the corner transitions between the two upper transverse surfaces 11 and 13 are sharp, preferably at right angles in relation to the upper defining surfaces of the pieces 1 and 2. In this context, it is also possible to conceive of causing the two wear surfaces 4 to extend one or possibly a few tenths of a millimeter outside the two upper transverse surfaces 11 and 13.

The pieces 1 and 2 are joined together in the following manner: the left-hand piece 1 in the Figure is considered as lying fixed on a substrate and, therefore, is included in a floor covering. The right-hand piece 2 in the Figure is inclined at an angle of 15–30° in relation to the piece 1, so that the arched or rounded edge of the projection 6 may readily slide over the flocking 9 in towards the accommodation space 5. On insertion of the projection 6 into the accommodation space, the right-hand piece 2 is gradually pivoted until it lies in the same plane as the left-hand piece 1. During this combined moving together and pivoting action, the flockings 9 will come into mesh with one another increasingly as the movement continues. Complete mesh does not occur until when the pieces 1 and 2 approach the entirely jointed position in a common plane. In order to minimise or wholly eliminate the gap between the upper transverse surfaces 11 and 13, it may possibly be appropriate to subject the right-hand edge of the right-hand piece 2 to careful impact during the final phase of the moving together of the pieces so that complete union of the pieces will thereby be guaranteed and complete mesh between their flockings.

DESCRIPTION OF ALTERNATIVE EMBODIMENTS

FIG. 2 shows a modified embodiment of the present invention. This embodiment has arisen so as to maximise the union of the pieces 1 and 2 of floor covering material. This maximisation must, however, be bought at the cost of a slightly weaker jointing of the pieces 1 and 2.

The difference vis-à-vis the embodiment according to FIG. 1 is substantially that the joint region between the pieces 1 and 2 has two groove-shaped accommodation spaces 5 and 5' for accommodating corresponding, bead-shaped projections 6 and 6'. The profiling of the pieces 1 and 2 according to FIG. 2 has further upper transverse surfaces 11, 13, respectively, which are arranged fully analogous with that disclosed above in connection with FIG. 1. Correspondingly, the joint region has lower transverse surfaces 12 and 14, which are also wholly analogous with the lower transverse surfaces carrying the same reference numerals and considered with reference to FIG. 1.

The surfaces on the pieces 1 and 2 which carry or cooperate with the flockings 9 or with the flocking 9, respectively, are disposed in the vertical direction approximately in the central region of the pieces, and are approximately parallel with the plane of extent of the pieces. The flocked surface or surfaces have been given the same reference numerals, 7 and 8, as the corresponding surfaces in the above-considered embodiment.

The flocked surfaces 7 and 8 may be seen as extensions or continuations of defining surfaces to the two grooves 5 and 5' respectively.

The present invention may be modified without departing from the scope of the appended claims.

What is claimed is:

1. A floor covering material, which comprises:

adjacent pieces of floor covering material facing toward one another in a joint;

upper and lower surfaces of each adjacent piece; and opposing edge portions of each adjacent piece between the upper and lower surfaces thereof profiled such that an edge portion of one piece has a groove-shaped space thereon and an opposed edge portion of the adjacent piece has a projection thereon facing and seated in the groove-shaped space, including mutually facing surfaces of the groove-shaped space and projection, wherein at least one of said mutually facing surfaces has a portion which extends beyond the groove-shaped space, wherein at least the portion which extends beyond the groove-shaped space includes flocking thereon, wherein said projection has an arched or rounded non-flocked edge with the arched or rounded non-flocked edge extending from the upper portion of said projection to the lower portion of said projection in a substantially continuous arched or rounded configuration for being able to readily be slid over the flocked portion of the at least one surface on said groove-shaped space.

2. A floor covering material according to claim 1, wherein the upper surface of each piece includes a wear layer thereon.

3. A floor covering material according to claim 2, wherein the lower surface of each piece includes a barrier layer thereon.

4. A floor covering material according to claim 1, wherein both of said mutually facing surfaces include flocking thereon.

5. A floor covering material according to claim 1, wherein the mutually facing surfaces are approximately parallel with the plane of the floor covering material.

6. A floor covering material according to claim 1, wherein one of the mutually facing surfaces faces upwards and is located on the piece with the groove-shaped space, and the other of said mutually facing surfaces faces downwards and is located on the piece with the projection.

7. A floor covering material according to claim 1, wherein one of the mutually facing surfaces defines at least a portion of the groove-shaped space.

8. A floor covering material according to claim 7, wherein the other of the mutually facing surfaces is on the projection.

9. A floor covering material according to claim 1, wherein the flocking extends along opposing edge portions which meet one another in a joint.

10. A floor covering material, which comprises:

adjacent pieces of floor covering material facing toward one another in a joint;

upper and lower surfaces of each adjacent piece; and opposing edge portions of each adjacent piece between the upper and lower surfaces thereof profiled such that an edge portion of one piece has a groove-shaped space thereon and an opposed edge portion of the adjacent piece has a projection thereon facing and seated in the groove-shaped space, including mutually facing surfaces of the groove-shaped space and projection, wherein at least one of said mutually facing surfaces includes flocking thereon, wherein opposing edge portions of each piece include both a groove-shaped space and projection, with each projection seated in an adjacent groove-shaped space, and wherein the flocking is at least in part located outside of the groove-shaped space.

* * * * *